US005407115A

United States Patent [19]

Blalock et al.

[11] Patent Number: 5,407,115

[45] Date of Patent: Apr. 18, 1995

[54] PRINTED RECEIPT SEVERING

[75] Inventors: Dolan F. Blalock, Kernersville; John S. McSpadden; Lester G. Ward, both of Greensboro; Paul D. Kaufman, Siler City, both of N.C.

[73] Assignee: Gilbarco, Inc., Greensboro, N.C.

[21] Appl. No.: 4,077

[22] Filed: Jan. 13, 1993

[51] Int. Cl.[6] ..... B26F 3/02; B65H 35/04; B67D 5/24

[52] U.S. Cl. ..... 225/1; 225/54; 225/91; 222/30

[58] Field of Search ..... 225/1, 15, 54, 80, 88, 225/90, 91, 92

[56] References Cited

U.S. PATENT DOCUMENTS

| | | | |
|---|---|---|---|
| 1,172,138 | 2/1916 | Hyman | 225/91 X |
| 1,348,791 | 8/1920 | Evans | 222/30 |
| 1,700,355 | 1/1929 | Fuller | 222/30 |
| 2,121,346 | 6/1938 | Harvey | 225/14 |
| 2,195,603 | 4/1940 | Steiner | 225/54 X |
| 2,202,011 | 5/1940 | Krueger et al. | 225/54 X |
| 2,215,052 | 9/1940 | Price et al. | 225/54 X |
| 2,250,326 | 7/1941 | Carroll | 222/19 |
| 2,636,691 | 4/1953 | Fritzinger | 242/55.53 |
| 2,670,043 | 2/1954 | Krueger et al. | 225/23 |
| 2,751,163 | 6/1956 | Waltz | 225/21 |
| 2,793,694 | 5/1957 | Vogt | 225/91 X |
| 2,805,714 | 9/1957 | Vogt | 225/91 X |
| 2,817,404 | 12/1957 | Vogt | 225/51 |
| 2,839,345 | 6/1958 | Engel et al. | 225/16 |
| 2,872,263 | 2/1959 | Andersson | 312/34.8 |
| 2,929,907 | 3/1960 | Collins | 242/55.53 |
| 3,039,664 | 6/1962 | Harrison et al. | 225/18 |
| 3,050,224 | 8/1962 | Drolshammer | 225/38 |
| 3,217,953 | 11/1965 | Bahnsen | 225/16 |
| 3,508,692 | 4/1970 | Holtan | 225/7 |
| 3,542,268 | 11/1970 | Schramm | 225/9 |
| 3,635,473 | 1/1972 | Sasaki et al. | 270/86 |
| 3,668,375 | 6/1972 | Smilgys et al. | 235/94 R |
| 3,743,150 | 7/1973 | Eckart, Jr. | 225/9 |
| 3,991,923 | 11/1976 | Nishikawa | 225/20 |
| 4,085,878 | 4/1978 | Nausedas | 225/19 |
| 4,267,949 | 5/1981 | Hemgren | 225/106 |
| 4,579,267 | 4/1986 | Planke | 225/54 |
| 4,787,542 | 11/1988 | Ruff et al. | 225/54 X |
| 5,135,146 | 8/1992 | Simhaee | 225/80 |

FOREIGN PATENT DOCUMENTS

| | | |
|---|---|---|
| 2705175 | 8/1978 | Germany . |
| 1306192 | 2/1973 | United Kingdom . |

OTHER PUBLICATIONS

Brochure entitled "Malibu Lifetime Crib", undated.

*Primary Examiner*—Richard K. Seidel
*Assistant Examiner*—Raymond D. Woods
*Attorney, Agent, or Firm*—Rhodes, Coats & Bennett

[57] ABSTRACT

A printed paper dispensing and severing apparatus includes an elongated paper to be printed, dispensed and severed. A printer including a positive drive mechanism projects paper along a guide path to an exit chute in a housing, the guide path being defined at least in part by a deflection plate so that the projection of the paper will encounter the deflection plate and be guided to exit the housing. A cutting mechanism adjacent the guide path includes a blade with a centrally peaked ridge in a guide surface generally parallel to the guide path. The reliability of this mechanism is dramatically improved due the absence of moving parts in the guide path, cutter blade, deflection plate and exit chute. The guide path and the exit chute are angled to one another, the elongated paper is provided in the form of a roll of paper which gives the paper a curl and the curl of the paper is in the same sense as the angle. Thus, paper projected along the guide path by the positive drive mechanism passes against the blade and through the exit chute to exit the housing in an untensioned condition. The subsequent application of a tension to the paper cuts the paper against the blade, producing an essentially straight cut.

26 Claims, 2 Drawing Sheets

PRINTED RECEIPT SEVERING

BACKGROUND OF THE INVENTION

The present invention relates to improved means for severing paper such as printed receipts.

The invention is particularly useful for automated self-service fueling pumps in which a customer's credit or debit card is automatically read and the fueling pump generates a receipt for the customer. It may also be used in any suitable circumstance in which lengths of paper are to be projected from a supply and intermittently severed from the supply. The receipt is printed on paper which is supplied in the form of a roll. The paper roll is rotated by the driving of the paper through the printer, which has a pinch roller. The paper continues past the printer to the exit chute, from which the customer can easily grasp and take away his receipt. Some of the problems faced in the design of this equipment include the exposure of the mechanism to harsh environmental circumstances since the fueling pump is usually located outdoors and the exposure to vandalism, which such a location risks. It is known to provide an active cutter, such as a scissors or a rotary cutter to traverse the paper and thereby sever it, but the provision of driving force for the active cutter to cause the traversal of the paper make for a complicated and expensive construction.

To avoid this, there have been prior art mechanisms which generate the receipt from pre-cut paper, but these have their own complications due to the need to feed individual sheets and also have the drawback of preventing various sizes of sheets from being used. Another aspect of the outside location of the receipt dispensing chute is the exposure of the receipt to the elements before the customer takes it. As can be appreciated, if the customer decides not to take his receipt, wind and rain could turn the receipt into undesirable waste paper.

It is desirable from an aesthetic and customer relations point of view that the receipt be out cleanly to present a neat appearance to the customer.

It is known to sever receipts with a knife in which the paper is deflected away from the knife as shown in U.S. Pat. No. 4,579,267 to Planke, but it is not believed that such apparatus is capable of providing as clean a out as desired or to reliably feed past the knife.

It is also known to provide retractable means as shown in U.S. Pat. No. 3,991,923 to Nishikawa to shield a blade for purposes of preventing inadvertent cuts of hands and the like. However, the provision of a convenient tear bar for receipt cutting for use in fueling dispensers and the like, providing a clean, straight-across and easy-to-implement cut, while increasing the reliability by using no moving parts, is a need that is as-of-yet unfulfilled.

SUMMARY OF THE INVENTION

The present invention fulfills this need in the art by providing a printed paper dispensing and severing apparatus. The paper is preferably provided as an elongated paper to be printed, dispensed and severed. A printer includes a positive drive mechanism to project paper along a guide path in a housing. The guide path is defined at least in part by a deflection plate so that the projected paper will encounter the plate and be guided to exit the housing.

A severing mechanism adjacent the guide path includes a blade having a cutting edge along a line that is not a straight line and is located on an imaginary surface substantially equidistant from a pinch point upstream of the cutting edge.

A preferred blade has a peaked ridge generally parallel to the guide path and is of a generally sheet material having a surface protruding toward the guide path, so that a most-protruding point contacts the paper first during a cutting operation and begins the paper cut. From there the cut continues along the blade edge until the paper is completely severed. Typically, the most protruding ridge is central to the surface, but that is not necessary. Also typical is for the surface to be configured as the intersection of two planes, although a curved surface or more planes can be used.

The configuration of the blade per se will be affected by how it is mounted adjacent the guide path. If the blade is formed as the intersection of two planes and the amount of protrusion is not great, the cutting edges may be straight, since the cutting of the paper as it passes the blade edge will approximate a straight line. If the protrusion is great or the blade is a curved surface, a curving, variable angle may be better.

The guide path continues to an exit chute downstream of the blade which is angled to the guide path. Typically and desirably, the elongated paper is provided in the form of a roll of paper which gives the paper a curl, and the curl of the paper is in the same sense as the angle between the guide path and the exit chute.

Thus, paper projected along the guide path by the positive drive mechanism passes over the blade and through the exit chute to exit the housing in an untensioned condition. The subsequent application of a tension to the projected paper snugs the paper against the blade and then tensions the paper against the blade to sever the paper. Continued tension on the paper results in the removal of the printed and severed paper from the guide path. As will be apparent, the tension is typically provided by a person pulling on the free end of the paper. Since the pull will be straight, in line with the length of the paper, no skewing resulting in crooked cuts takes place. Since the severing apparatus has no moving parts, it is inexpensive to fabricate and highly reliable.

A sensor may be provided to detect the presence or absence of paper jam. It is operatively coupled to the drive mechanism to permit projection of the paper when the absence of a paper jam is detected.

The invention is preferably embodied in a fuel dispenser including a printed receipt dispensing and cutting apparatus.

The invention also provides a paper cutting apparatus for cutting elongated paper including an elongated paper guide path, a blade adjacent to and generally parallel to the guide path having a cutting edge along a line that is not a straight line and is located on an imaginary surface substantially equidistant from a paper pinch point upstream of the cutting edge. Thus, paper projected along the guide path passes over the blade in an untensioned condition, and the subsequent application of a tension to the projected paper tensions the paper to the blade edge to cut the paper with a substantially straight cut. The tensioning and cutting does not force the paper into a position which would inhibit the flow of the next receipt. Typically, the cutting edge of the blade has a profile with a central peak.

In a preferred embodiment the blade is of a generally sheet material having a surface protruding toward the guide path, so that a most-protruding point contacts the paper first during a cut and begins the paper cut. Preferably, the surface is configured as two intersecting planes.

The invention also provides a method of dispensing and cutting paper including passing paper to be dispensed and cut along a guide path and past a blade generally parallel to the guide path having an edge along a line that is not a straight line and is located on an imaginary surface substantially equidistant from a paper pinch point upstream of the cutting edge to an exit downstream of the guide path. This is followed by applying tension to the paper at the exit to tension the paper against the edge to cut the paper with a substantially straight cut.

Preferably, the passing step takes the form of positively driving the paper from a positive drive upstream of the blade, such as driving the paper out of a printer. Preferably the tension is applied at an angle of not more than 60° to the cutting edge. The positive driving step may include driving the paper against a plate to project a cut end of the paper beyond the blade edge at an angle to the guide path.

BRIEF DESCRIPTION OF THE DRAWINGS

The invention will be better understood from a reading of the detailed description of the preferred embodiment along with a review of the drawings in which.

DETAILED DESCRIPTION OF THE PREFERRED EMBODIMENT

Figure 4:
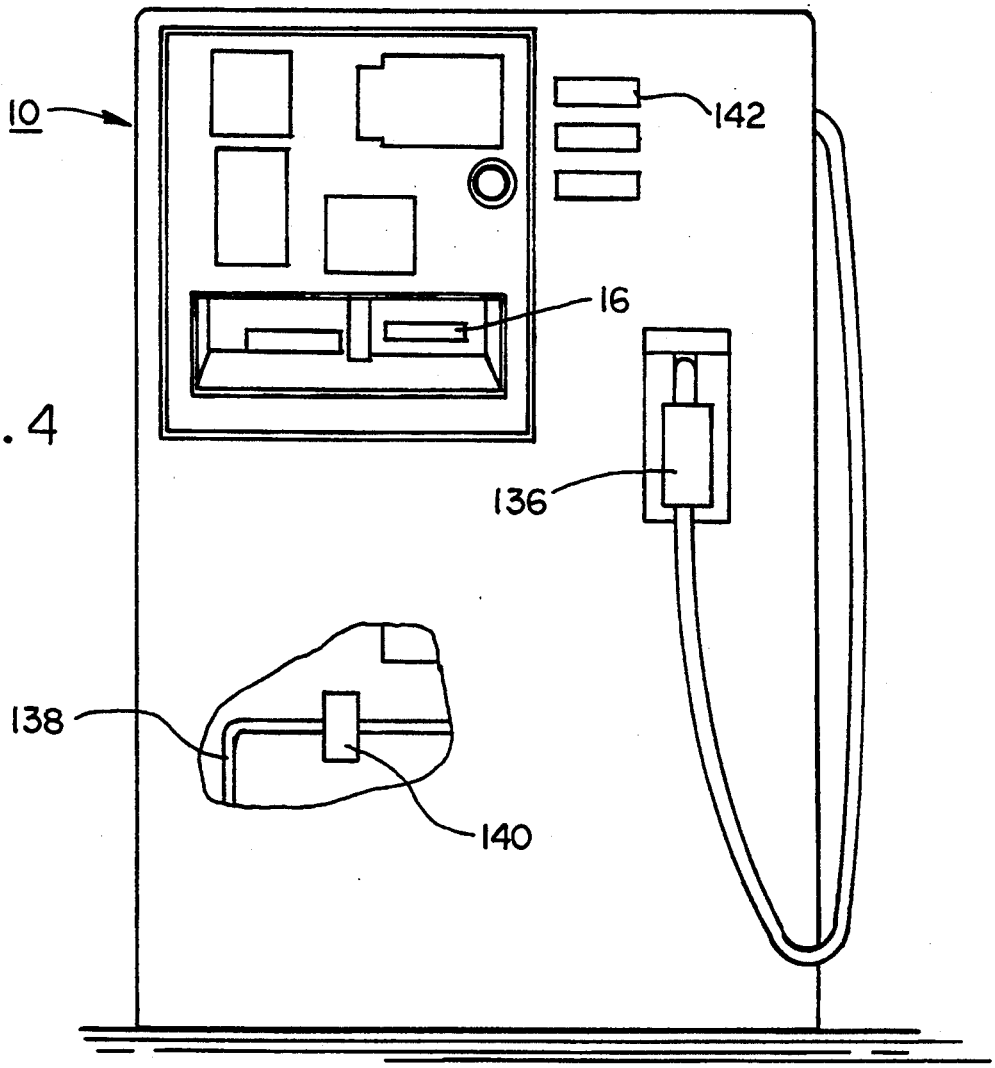
FIG. 4 is an elevation view of a fuel dispenser embodying the invention.

Referring to FIG. 4, there is shown a housing 10 of a fuel dispenser or other unit from which the receipt or other paper is to be dispensed. The fuel dispenser housing 10 includes a hose apparatus 136 for dispensing fuel delivered along a line 138. The amount of fuel is measured by a conventional pulser 140 which passes fuel delivery data to a display 142. At the end of a transaction, transaction data is printed on a receipt delivered through exit chute 16.

Referring back to FIG. 1, chute 16 includes a curved deflector plate 32 and lower. plate 34. The housing 10 supports a paper roll 18 with a paper take-off from the roll through the rear of the roll, up through a printer 20. The printer 20 includes a pinch roller 22, which engages the paper as it passes through the printer to positively drive it through the printer, pulling it off of the paper roll 18 and driving it toward the curved deflector plate 32. In an untensioned condition, the paper assumes a path shown in the leftmost dashed line in FIG. 1.

A blade 24 extends across the width of the chute, generally parallel or otherwise aligned with the paper path coming off the pinch roller 22. (In fact, the blade 24 serves as a lower boundary of the guide path and permits free ends of paper to pass over it toward the plate 32 with minimal friction.)

Figure 2:
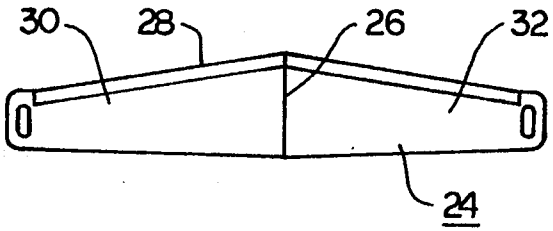
FIG. 2 is a plan view of the blade used in the embodiment shown in FIG. 1.
Figure 1:
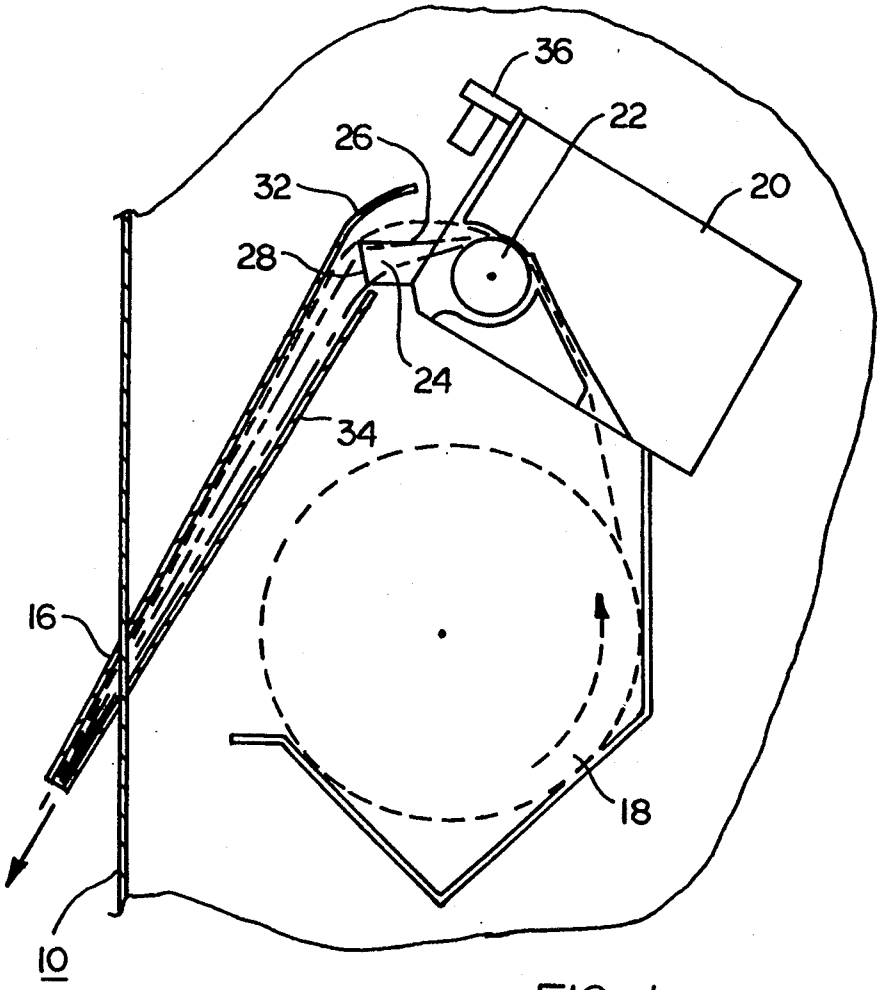
FIG. 1 is a sectional view through a receipt printer and dispenser showing one embodiment of the invention.

As can be seen in FIG. 2, the blade 24 has a profile with a ridge 26 in the center, protruding toward the paper guide path. The sharpened edge 28 of the blade is on the downstream end of the blade, exposed to the intersection of the paper guide path and the exit chute. The blade as shown in FIGS. 1 and 2 is provided in the form of a pair of intersecting planes 30,32, but could be curved. The two intersecting planes are shown meeting at a central ridge 26 of the blade, but could meet elsewhere. Also, the two planes could be inverted to form a trough-shaped blade, with the central portion being less-protruding toward the guide path than the edges. What is important is that a portion of the blade be protruding so that tension on the paper will cause the paper to contact the blade at the protruding portion and concentrate the tension there. This causes the blade edge at the protrusion to pierce the paper and start the cut. Generally, the greater the amount of protrusion, the easier it is to start the cut.

Figure 3:
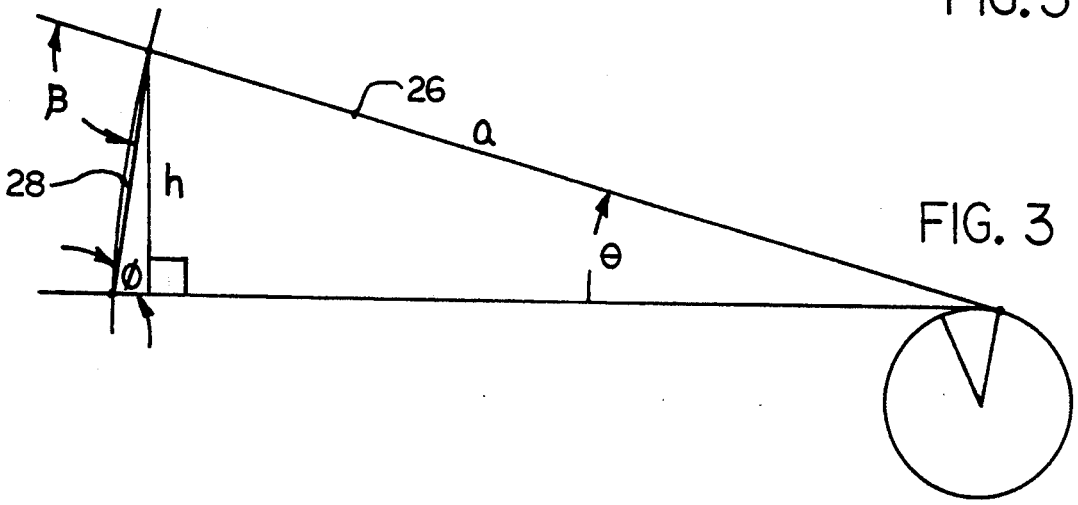
FIG. 3 is a schematic view illustrating the geometrical considerations to be taken into account in shaping the blade.

The less protruding portions of the cutting edge 28 lie on a surface equidistant from the pinch point of the paper by the roller 22 in a fashion to be described in more detail, so that as the cut spreads along the width of the paper, the length of paper from the pinch roller to the cutting edge stays substantially constant. This results in a cut that is substantially straight across the width of the paper. The configuration of the blade edge is dependent on the amount of projection of the protruding portion, the location of the pinch roller and the mounting position of the blade, as can be seen in FIG. 3.

Assuming that the paper is properly held at the pinch roller 22, the movement of a portion of the paper a constant distance "a" from the pinch point during the cut as the paper passes down the blade will be a portion of a cylinder, subtended by an angle $\theta$. This arc can be approximated by straight edges. Assuming the amount of protrusion of the blade is h, we have $$\tan \phi = h/d$$

$$d = a - a \cos \theta$$

$$\cos \theta = (1 - \sin^2\theta)^{\frac{1}{2}}$$

$$\sin \theta = h/a$$

$$\tan \phi = \frac{h}{a(1 - (1 - (h/a)^2)^{\frac{1}{2}})}$$

Figure 5:
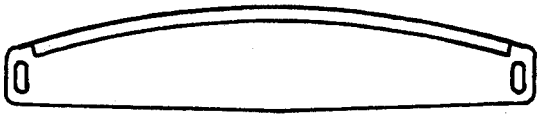
FIG. 5 is a plan view like FIG. 2, but an alternate embodiment of the blade.

Thus, if the sharpened edge 28 of the blade 24 is provided as a straight line chord on the cylinder at an angle $\phi$ as defined, the chord will approximate the curvature of the fixed radius of rotation. Assuming that $\phi$ is small and the width of the cutting blade surface is large compared to h, the angle $\phi$ gives a practically straight cut. If the blade edges are made to be straight, there will be a slight scalloping effect, but the cut approximates a straight cut. If desired, the edge can be machined to a more curved configuration so that a perfectly straight cut is obtained. For example, the edge could be shaped somewhat like the tongue of a shoe, with a curved protrusion and curved edges as sum in FIG. 5. However, such a configuration would appear to be more expensive to manufacture, and applicant has not found it necessary to go to that expense.

Another source of possible error causing a cut not to be straight is the wrapping of the paper around the pinch roller, if the pinch roller radius is large enough and the angle $\theta$ is large enough. In most cases, however this error, too, can be ignored. Actually, the error due to wrapping will tend to negate the error due to a straight chord, so that ignoring both errors provides satisfactory results.

Prior art tear bars normally require a side-to-side pulling action to initiate tearing. In this invention, since the chute 16 permits only longitudinal tension to be applied to the paper and the customer knows only to pull in that direction, the configuration of the blade makes use of tension in that direction. It is desirable to make the chute at a substantial angle to the edge of the blade, to effectively focus the tension. Preferably the angle $\beta$ between the pull and the cutting edge surface is less than 60°. This reduces the force needed to start the cut.

The peak in the center of the blade contacts the center of the paper first as the paper is put under tension, since the blade edge is an inside corner for the paper path. The peak punctures the center of the paper so that further movement of the paper down the blade spreads that puncture laterally along the width of the blade to finish severing the receipt, with the paper assuming the paths of the dash-dot lines of FIG. 1 as the cut proceeds. As will be apparent, the completion of the severing of the receipt permits the customer's applied tension to finish withdrawing the receipt from the chute.

The blade, extending as an inside corner of the paper path, guides the paper as it is being driven from the pinch roller against the curved plate 32 and into the exit chute. Thus, when the next customer's transaction results in the paper being forwarded by the driving of pinch roller 22, the paper will assume the path shown in the leftmost dashed line in FIG. 1. That is, the paper will be driven forwardly until it contacts the curved deflector plate 32 and follow that deflector plate down the chute 16.

If desired, a paper jam sensor 36 may be provided. It uses a photoelectric cell and illumination to determine the presence of the paper extending past pinch roller 22 and to signal a malfunction should paper be present when not expected. It is operatively connected to the printer to permit paper advances only when no jam is detected.

A particularly valuable advantage of the present invention is that the size of the receipt presented to the customer may be altered simply by changing the length of the chute 16 and the amount of paper driven to the pinch roller. That is, if one purchaser of the apparatus wants to present longer receipts to his customer than another purchaser does, the vendor of the apparatus need only make a minor modification in the length of the chute and a software change to accommodate those purchasers.

Also, since the blade 24 is located inside of the housing 10, a user never comes in contact with it and cannot be cut by it. While a blade of sheet material is preferred, it could be provided as a solid block properly configured.

The provision of the paper on roll 18 may tend to cause the paper to have a bit of a curl. However, as can be seen with respect to FIG. 1, that curl is used to advantage, since the only critical projection of the paper is from the printer 20.

The curl gives the paper an inside face inside the curl and facing the blade 24. This makes the paper easily guidable onto the blade 24 from which it is directed into the chute.

Also, since the paper stays attached to the paper roll and largely contained within the chute 16 until the customer pulls the paper receipt, the paper is protected from the rain and cannot blow away in the wind.

As used in the application, the term "pinch point" refers to a point upstream of the blade about which the paper will rotate in the event of cut, even if the actual pinching or securing against paper advances is yet further upstream. References to the cutting edge being on a surface substantially equidistant from a pinch point include surfaces defined by taking wrapping of the paper about a pinch roller or other obstacle into account, and approximations to reduce manufacturing costs. Also, the term "substantially straight cut" refers to a cut that is deemed acceptably straight for commercial purposes. The degree of precision of straightness will be affected by various factors including, in particular, the properties of the paper to be cut.

As will be apparent, various modifications to the preferred embodiment described herein may be made and still fall within the scope of the appended claims.

What is claimed is:

1. A paper dispensing and cutting apparatus comprising:

a. a roll of paper to be dispensed and cut, said paper being unperforated at locations to be cut and having a curl in the same sense as its residence on the roll so that the paper has an inside face inside the curl, b. a positive drive mechanism to project said paper along a guide path in a housing to an exit chute downstream of said guide path, said positive drive mechanism operating in a manner that does not negate said curl, and c. a cutting mechanism adjacent said guide path including a blade generally parallel to said guide path having an edge along a line that is not a straight line and is located on a surface substantially equidistant from a paper pinch point upstream of said edge, said blade facing said inside face of said paper, whereby paper projected along said guide path by said positive drive mechanism passes against said blade and through said exit chute in an untensioned condition and a subsequent application of tension to the projected paper tensions said paper to said edge to cut the paper with a substantially straight cut.

2. An apparatus as claimed in claim 1 in which said blade has a ridge with a central peak.

3. An apparatus as claimed in claim 1 wherein said blade is of a generally sheet material having a guide surface protruding toward the guide path, so that a most-protruding point contacts the paper first during a cutting operation and begins the paper cut.

4. An apparatus as claimed in claim 3 wherein said blade has a central ridge and said most protruding point is at a peak of said central ridge.

5. An apparatus as claimed in claim 3 wherein said guide surface is configured as two intersecting planes.

6. An apparatus as claimed in claim 3 wherein said guide surface is curved.

7. An apparatus as claimed in claim 3 wherein said guide surface is formed as two intersecting planes and the edge is sharpened.

8. An apparatus as claimed in claim 3 wherein said guide surface is curved and the edge is sharpened.

9. An apparatus as claimed in claim 1 in which said positive drive mechanism is a printer.

10. An apparatus as claimed in claim 1 in which said guide path is angled to said exit chute at said blade edge.

11. An apparatus as claimed in claim 1 in which said guide path is defined at least in part by a deflection plate opposite said blade so that the projection of a cut end of the paper past said blade edge will encounter said deflection plate and be guided to said exit chute.

12. An apparatus as claimed in claim 11 in which said cutting edge of said blade is angled to said exit chute at an angle less than 60°.

13. An apparatus as claimed in claim 1 in which said guide path is angled to said exit chute, and the curl of the paper is in the same sense as the angle between said guide path and said exit chute.

14. An apparatus as claimed in claim 1 further comprising a sensor downstream of said drive mechanism to detect the presence or absence of a paper jam downstream of said drive mechanism and operatively coupled to said drive mechanism to prevent the projection of said paper when a paper jam is detected.

15. A fuel dispenser including a printed receipt dispensing and cutting apparatus comprising:

a. apparatus for dispensing fuel and metering apparatus to monitor the amount of fuel dispensed, b. a roll of paper to be printed with information, said paper being unperforated at locations to be cut and having a curl in the same sense as its residence on the roll so that the paper has an inside face inside the curl, c. a printer to print information related to the amount of fuel dispensed and including a positive drive mechanism to project said paper along a guide path to an exit chute in a housing, said positive drive mechanism operating in a manner that does not negate said curl, said guide path being defined at least in part by a curved plate so that the projection of the paper will encounter said curved plate and be guided to said exit chute to exit said housing, d. a cutting mechanism adjacent said guide path including a blade with a centrally peaked ridge substantially parallel to said guide path and angled to said exit chute, said blade facing said inside face of said paper, and e. said guide path and said exit chute being angled to one another, and the curl of the paper being in the same sense as said angle between said guide path and said exit chute, whereby paper projected along said guide path by said positive drive mechanism passes over said blade and through said exit chute to exit said housing in an untensioned condition and a subsequent application of tension to the projected paper exposes the tensioned paper to said blade to cut the paper.

16. A paper cutting apparatus for cutting elongated paper comprising:

a. a roll of paper from which the paper is dispensed so that the paper is unperforated at locations to be cut and has a curl in the same sense as its residence on the roll, the paper has an inside face inside the curl, and the paper is dispensed in a manner that does not negate said curl, b. an elongated paper guide path, c. a blade adjacent to and generally parallel to said guide path having an edge along a line that is not a straight line and is located on a surface substantially equidistant from a paper pinch point upstream of said edge, said blade facing said inside face of said paper, whereby paper projected along said guide path passes against said blade in an untensioned condition and a subsequent application of tension to the projected paper tensions said paper to said blade edge to cut the paper with substantially straight cut.

17. An apparatus as claimed in claim 16 in which said blade has a protruding portion that has a profile with a central ridge.

18. An apparatus as claimed in claim 16 wherein said blade is of a generally sheet material having a guide surface protruding toward the guide path, so that a most-protruding point contacts the paper first during a cut and begins the paper cut.

19. An apparatus as claimed in claim 18 wherein said blade has a central ridge and said most-protruding point is at a peak of said central ridge.

20. An apparatus as claimed in claim 18 wherein said guide surface is configured as two intersecting planes.

21. An apparatus as claimed in claim 18 wherein said guide surface is curved.

22. A method of dispensing and cutting paper comprising:

a. passing curled paper having an inside face inside its curl to be dispensed and cut 1) along a guide path in a manner that does not negate said curl;

2) past a blade that faces the inside face of the curl, said blade being generally parallel to the guide path and having an edge along a line that is not a straight line and that is located on a surface substantially equidistant from a paper pinch point upstream of the edge 3) to an exit downstream of the guide path, and b. applying tension to the paper at the exit to tension the paper against the edge to cut the paper at an unperforated location with a substantially straight cut.

23. A method as claimed in claim 22 wherein said passing step comprises positively driving the paper from a positive drive upstream of the blade.

24. A method as claimed in claim 23 in which said passing step comprises driving the paper out of a printer.

25. A method as claimed in claim 23 in which said passing step includes driving the paper against a plate to project a cut end of the paper beyond the blade edge at an angle to the guide path.

26. A method as claimed in claim 22 in which the tension is applied at an angle of at most 60° to the blade edge.

* * * * *

UNITED STATES PATENT AND TRADEMARK OFFICE

CERTIFICATE OF CORRECTION

PATENT NO. : 5,407,115

DATED : April 18, 1995

INVENTOR(S) : Lester G. Ward, et. al.

It is certified that error appears in the above-indentified patent and that said Letters Patent is hereby corrected as shown below:

Title page, item [75], inventor: add-- Roger William Stout, 2210 Ledford Road, Greensboro, NC 27406--.

Signed and Sealed this

Twenty-eighth Day of January, 1997

*Attest:*

Bruce Lehman

BRUCE LEHMAN

*Attesting Officer*

*Commissioner of Patents and Trademarks*